US007006048B2

(12) United States Patent
Chang

(10) Patent No.: US 7,006,048 B2
(45) Date of Patent: Feb. 28, 2006

(54) DUAL OPERATIONAL FREQUENCY SLOT ANTENNA

(75) Inventor: The-Nan Chang, Taipei (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/978,585

(22) Filed: Nov. 2, 2004

(65) Prior Publication Data

US 2005/0088354 A1 Apr. 28, 2005

(51) Int. Cl.
*H01Q 13/10* (2006.01)

(52) U.S. Cl. ..... 343/767; 343/702

(58) Field of Classification Search ..... 343/700 MS, 343/702, 767

See application file for complete search history.

(56) References Cited

U.S. PATENT DOCUMENTS

| | | | | |
|---|---|---|---|---|
| 6,606,071 | B1 * | 8/2003 | Cheng et al. | 343/767 |
| 6,741,214 | B1 * | 5/2004 | Kadambi et al. | 343/700 MS |
| 6,937,200 | B1 * | 8/2005 | Takei | 343/767 |
| 2002/0033773 | A1 * | 3/2002 | Hirabayashi | 343/702 |
| 2003/0184484 | A1 * | 10/2003 | Ikegaya et al. | 343/767 |
| 2005/0116870 | A1 * | 6/2005 | Wang et al. | 343/767 |

* cited by examiner

*Primary Examiner*—Tan Ho
(74) *Attorney, Agent, or Firm*—Bacon & Thomas, PLLC

(57) ABSTRACT

A dual operational frequency slot antenna for receiving/transmitting wireless signals from a satellite or for receiving/transmitting wireless signals in an RFID system comprises two L-type slot antennas and a printed circuit feed line to receive and transmit circularly polarized radiation at dual operational frequencies.

5 Claims, 3 Drawing Sheets

DUAL OPERATIONAL FREQUENCY SLOT ANTENNA

BACKGROUND OF THE INVENTION

1. Field of the Invention

The present invention relates to a slot antenna and, more particularly, to a dual operational frequency slot antenna for receiving and transmitting at dual operational frequencies using a circularly polarized wave.

2. Description of the Related Art

Portable communication systems often use circularly polarized radiation. Several applications further require a dual-band circularly polarized operation. For example, a dual-band right-hand circularly polarized antenna for GPS applications operates at both 1575.42 and 1227.60 MHz. For other potential applications, circularly polarized antenna is suitable to be used in a reader to detect tags in an RFID (Radio Frequency IDentification) system because the tags may not be polarized in a fixed direction. The operating frequency for RFID systems can be in a UHF (860–930 MHz) or in a microwave (2.45 GHz) band. For dual-band operation, the reader's antenna can be designed to transmit/receive two circularly polarized radiation signals at two different frequencies. The type of the antenna can best be a microstrip or a slot antenna, which helps to reduce the overall size of the conventional antenna. A lot of microstrip antenna technologies are existed, such as U.S. Pat. No. 6,509,873, entitled "Circularly polarized wideband and traveling-wave microstrip antenna", or U.S. Pat. No. 6,522,302, entitled "Circularly-polarized antennas". However, the above-mentioned technologies only operate at a single frequency.

Therefore, it is desirable to provide a dual operational frequency slot antenna to mitigate and/or obviate the aforementioned problems.

SUMMARY OF THE INVENTION

The present invention provides a dual operational frequency slot antenna for transmitting/receiving circularly polarized signals.

The dual operational frequency slot antenna for receiving/transmitting wireless signals from a satellite or for receiving/transmitting wireless signals in an RFID system, comprising: a F-type slot antenna for receiving and transmitting a wireless signal at a first working frequency and a wireless signal at a second working frequency; and a feed line for receiving and transmitting the wireless signals at the first working frequency and the second working frequency; wherein the F-type slot antenna is consisted of two L-type slot antennas, and the feed line is a metal line and made of printed circuit.

Other objects, advantages, and novel features of the invention will become more apparent from the following detailed description when taken in conjunction with the accompanying drawings.

DETAILED DESCRIPTION OF THE PREFERRED EMBODIMENT

A dual operational frequency slot antenna 10 of the present invention comprises a slot antenna and a feed line. The slot antenna is adapted to receive circularly polarized radiation at different frequencies and transmit circularly polarized radiation to the free space. The size of the slot antenna and the feed line are small, therefore the size of the dual operational frequency slot antenna 10 is decreased.

Figure 1:
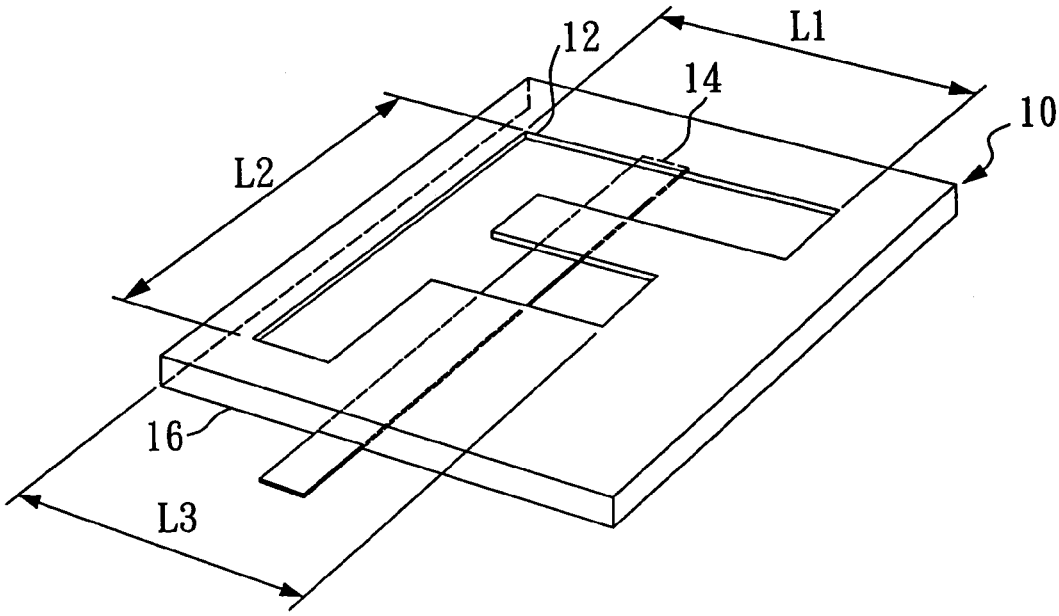
FIG. 1 is a schematic drawing of a dual operational frequency slot antenna according to the present invention.

FIG. 1 is a schematic drawing of the dual operational frequency slot antenna 10. The dual operational frequencies slot antenna 10 comprises:

an F-type slot antenna 12 which is composed of two L-type slot antennas; each L-type slot antenna is adapted to receive and transmit circularly polarized radiation at a single frequency. Therefore, the F-type slot antenna 12 can transmit and receive two different frequencies of circularly polarized radiation. As shown in the drawing, the F-type slot antenna 12 can be divided into three sections: L1 (for example, 0.029 m in length), L2 (for example, 0.038 m in length), and L3 (for example, 0.018 m in length). The combination of sections L1 and L2 can receive circularly polarized radiation with a first frequency (for example, 900 MHz), and the lengths of sections L1 and L2 are preferably half or one fourth of the wavelength of the first frequency. As the dual operational frequency slot antenna 10 can work under two different working frequencies, the first frequency may be lower than the second frequency (which may be, for example, 2450 MHz), and the section for receiving the second frequency is shorter than the section for receiving the first frequency. Therefore, a portion of section L2 and section L3 can be adapted to receive circularly polarized radiation at the second frequency, and the lengths of sections L2 and L3 are preferably half or one fourth the wavelength of the second frequency. Of course, the first frequency and the second frequency can be modified based on the demand of the user, such as 1227 MHz and 1575 MHz.

A feed line 14 is a metal conductor manufactured using printed circuit technology. The metal conductor is preferably copper, and has a length which is half or one fourth of the wavelength of the first frequency. The feed line 14 is disposed below sections L1 and L3. The dual operational frequency slot antenna 10 utilizes the feed line 14 to output obtained signals. The feed line 14 can receive circularly polarized radiation of the first frequency and the second frequency for subsequent processes (not shown), and transmit the circularly polarized radiation of the first frequency and the second frequency output from the subsequent processes to a far end.

A bottom face 16 is made of a metallic material, which provides a metal shielding effect. Consequently, the radiation direction of the F-type slot antenna 12 has a single direction. It is well known in the art that the bottom face 16 can also be made of a non-metallic material.

Figure 2:
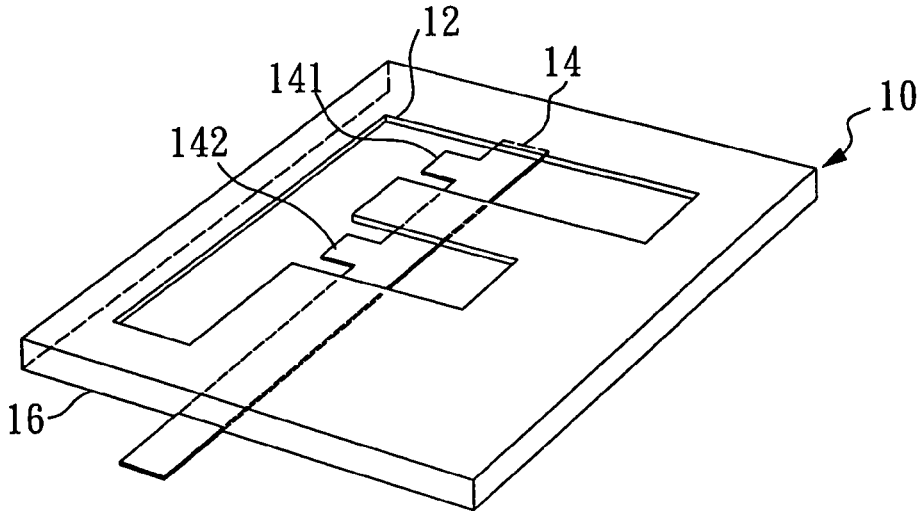
FIG. 2 is a schematic drawing of another dual operational frequency slot antenna according to the present invention.

Different types of feed lines 14 can provide different signal reception capabilities and signal transmission capabilities. As shown in FIG. 2, the feed line 14 can be connected to a first feed line 141 (for example, 0.00877 m in length) and a second feed line 142 (for example, 0.00544 m in length), and the lengths of the first feed line 141 and the second feed line 142 can be adjusted to increase the signal reception capabilities of the dual operational frequency slot antenna 10 for the circularly polarized radiation.

Figure 3:
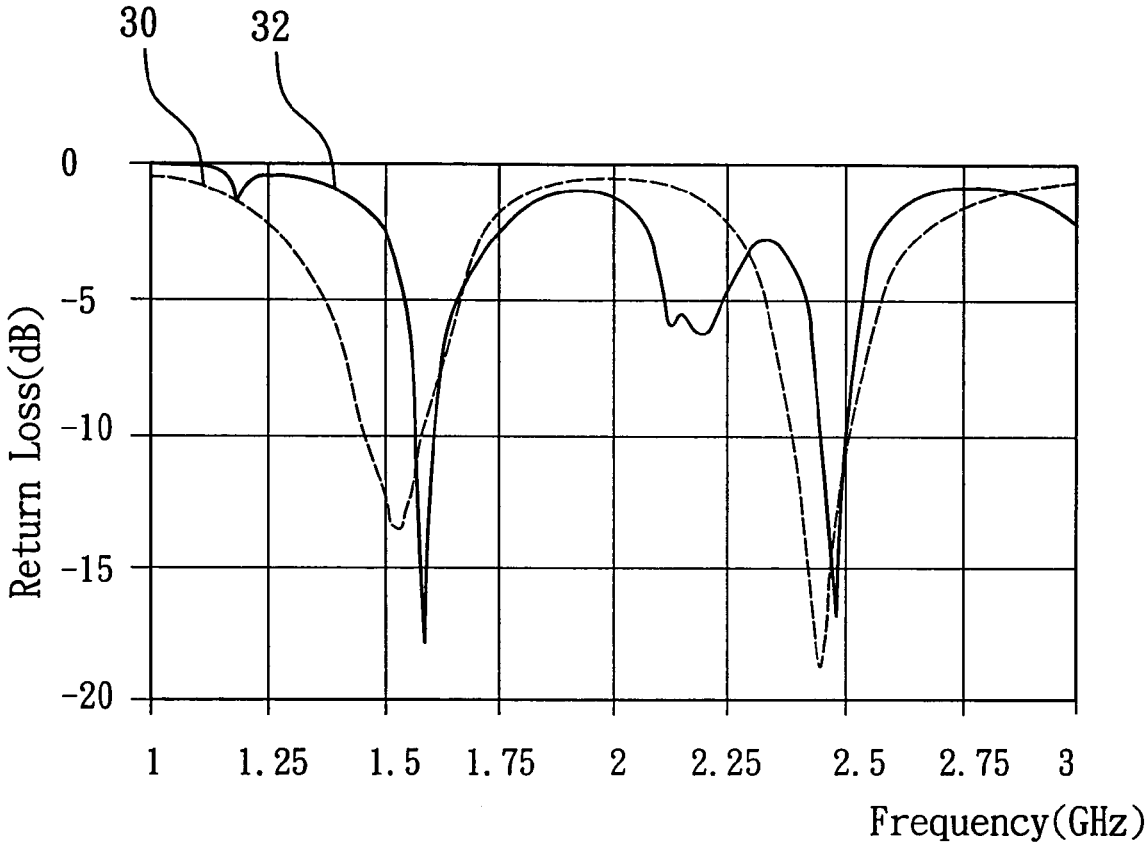
FIG. 3 is a waveform drawing showing theoretical return loss and actual return loss.

FIG. 3 is a waveform drawing showing simulated return loss and actual return loss. According to a computer-simulated waveform 30 of the return loss, when the dual operational frequency slot antenna 10 transmits circularly polarized radiation with frequencies near the first frequency and the second frequency, these waves obviously have a low return loss, which indicates that the dual operational frequency slot antenna 10 works very well at these two frequencies. With reference to a waveform 32 of the actual return loss, although the computer-simulated waveform 30 and the waveform 32 are different, they both exhibit very low return losses. Therefore, the present invention achieves the performance in both theory and actual application.

Figure 4:
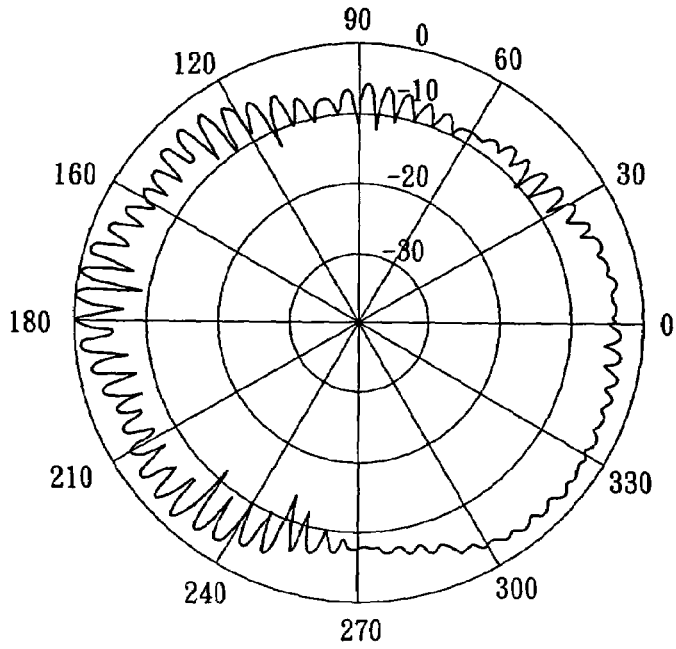
FIG. 4 is an axial ratio field drawing of a first working frequency of the slot antenna according to the present invention.
Figure 5:
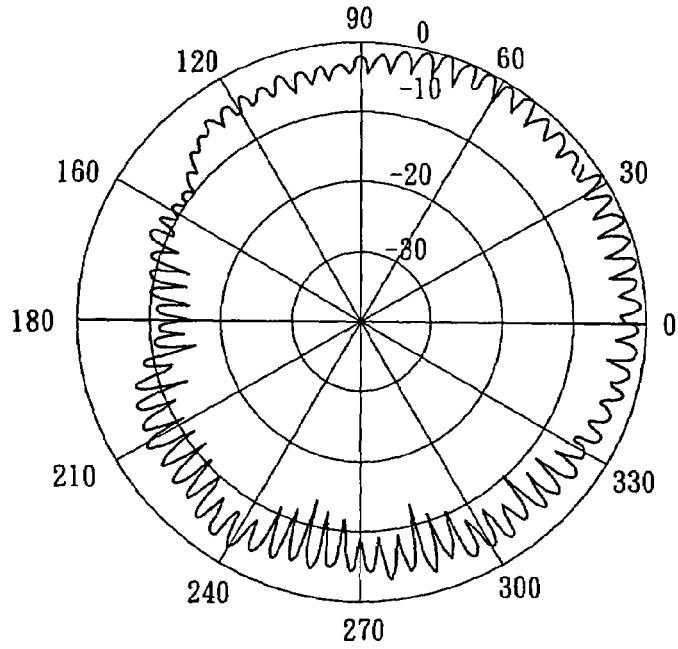
FIG. 5 is an axial ratio field drawing of a second working frequency of the slot antenna according to the present invention.

FIG. 4 is an axial ratio field drawing of the dual operational frequency slot antenna 10 with the first working frequency. Since axial ratio values in a wide angular range are all less than 3 dB, the present invention achieves the desired characteristics. FIG. 5 is an axial ratio field drawing of the dual operational frequency slot antenna 10 with the second working frequency. Again, since the axial ratio values in a wide angular range are all less than 3 dB, the present invention achieves the desired characteristics.

Accordingly, the present invention can operate at two different working frequencies, and with a smaller size, to receive circularly polarized radiation at dual operational frequencies from a satellite.

Although the present invention has been explained in relation to its preferred embodiment, it is to be understood that many other possible modifications and variations can be made without departing from the spirit and scope of the invention as hereinafter claimed.

What is claimed is:

1. A dual operational frequency slot antenna for receiving/transmitting wireless signals from a satellite or for receiving/transmitting wireless signals in an RFID system, comprising:

a F-type slot antenna for receiving and transmitting a wireless signal at a first working frequency and a wireless signal at a second working frequency; and a feed line for receiving and transmitting the wireless signals at the first working frequency and the second working frequency; wherein the F-type slot antenna is consisted of two L-type slot antennas, and the feed line is a metal line and made of printed circuit.

2. The dual operational frequency slot antenna as claimed in claim 1, wherein the feed line is connected to a first feed line and a second feed line.

3. The dual operational frequency slot antenna as claimed in claim 2, wherein the first working frequency is 900 MHz and the second working frequency is 2450 MHz.

4. The dual operational frequency slot antenna as claimed in claim 2, wherein the first working frequency is 1227 MHz and the second working frequency is 1575 MHz.

5. The dual operational frequency slot antenna as claimed in claim 1, wherein a lower face of the F-type slot antenna is metallic.

* * * * *